US006546772B2

(12) United States Patent
Höffgen et al.

(10) Patent No.: US 6,546,772 B2
(45) Date of Patent: Apr. 15, 2003

(54) ROLLING MILL, ESPECIALLY FOR INCLINED OR DIESCHER ROLLING

(75) Inventors: Walter Höffgen, Korschenbroich (DE); Paul Koenen, Krefeld (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 12 days.

(21) Appl. No.: 09/839,688

(22) Filed: Apr. 20, 2001

(65) Prior Publication Data

US 2002/0000113 A1 Jan. 3, 2002

(30) Foreign Application Priority Data

Apr. 27, 2000 (DE) ..... 100 20 702

(51) Int. Cl.[7] ..... B21B 19/00; B21B 31/00
(52) U.S. Cl. ..... 72/95; 72/237; 72/238
(58) Field of Search ..... 72/95, 237, 238, 72/239, 455

(56) References Cited

U.S. PATENT DOCUMENTS

| | | | | | |
|---|---|---|---|---|---|
| 4,052,876 | A | * | 10/1977 | Rotter | 72/237 |
| 5,113,682 | A | * | 5/1992 | Poloni | 72/237 |
| 5,295,379 | A | * | 3/1994 | Trbovich et al. | 72/97 |
| 5,590,557 | A | * | 1/1997 | Keller et al. | 72/238 |
| 5,875,671 | A | * | 3/1999 | Hauck et al. | 72/237 |
| 5,887,472 | A | * | 3/1999 | Abbey, III | 72/238 |
| 6,266,987 | B1 | * | 7/2001 | Goto et al. | 72/95 |

FOREIGN PATENT DOCUMENTS

| | | | | |
|---|---|---|---|---|
| GB | 2230986 | * | 11/1990 | B21B/31/12 |

* cited by examiner

*Primary Examiner*—Ed Tolan
(74) *Attorney, Agent, or Firm*—Herbert Dubno

(57) ABSTRACT

A rolling mill, especially an inclined roll or Diescher roll mill. Its stand is formed by a pair of portal frames on a cast plate on a foundation spaced apart by cassettes holding the upper and lower roll units and tie rods securing the portal frames against one another and the cassettes. The tie rods are spaced apart vertically or horizontally on the portal frames.

12 Claims, 4 Drawing Sheets

FIG. 3
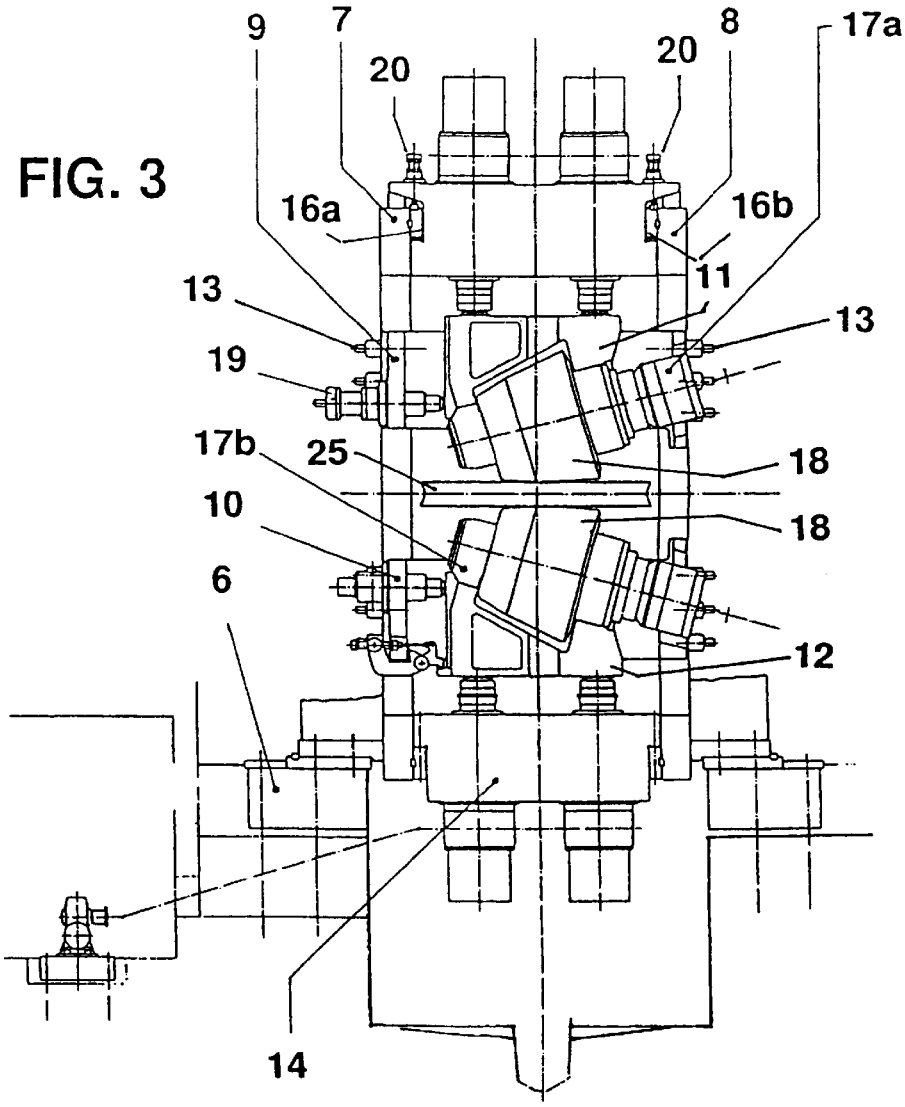
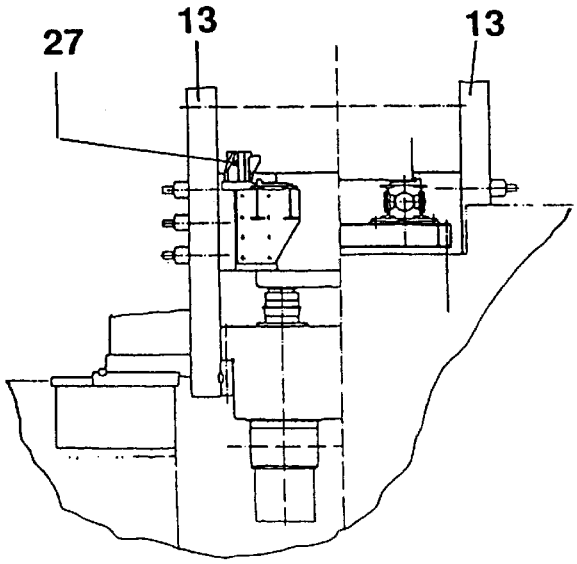
FIG. 4

ROLLING MILL, ESPECIALLY FOR INCLINED OR DIESCHER ROLLING

FIELD OF THE INVENTION

Our present invention relates to a rolling mill, especially an inclined-roll or a Diescher roll mill in a modular construction and, more particularly, to a rolling mill of this type having frames supporting the rolls and in the form of cast stand frames, welded plate stand frames or forged stand frames.

BACKGROUND OF THE INVENTION

Rolling mill stands are generally formed as one piece cast units which can be difficult to manufacture, are heavy and frequently are complex to erect since the available crane capacity may be limited and the personnel available for the erection may also limit the ability to set up the mill.

This is particularly the case for rolling mills of the inclined roll or Diescher roll (piercing mill) type. It should be recognized, moreover, that a rolling mill must take up the forces generated by the rolling processes and for holding, bracing and adjusting or maintaining adjusted positions of the rolls.

To eliminate the drawbacks of limited crane capacity and limited numbers of personnel in the erection of such rolling mills. It is known to form the rolling mill stand by a kind of modular construction in which the stand itself is assembled from smaller units. The modular constructions of earlier systems, however, have not been satisfactory in many respects.

OBJECTS OF THE INVENTION

It is, therefore, the principal object of the present invention to provide a rolling mill, especially an inclined-roll or Diescher roll mill, in a modular construction whereby assembly of the rolling mill, the manual operations involved in fabricating the rolling mill and especially in setting up the rolling mill frame or stand can be greatly simplified by comparison with earlier systems.

Another object of the invention is to provide a rolling mill, especially for the inclined roll or of the Diescher type in which the manual operations involved in setting up the mill are facilitated and more economical than has hitherto been the case in which the manual operations required handling of lighter weights than has been possible heretofore.

It is also an object of this invention to provide a rolling mill of the type described, which is not only more easily set up and has a lighter construction than prior art mills, but which nevertheless is capable of absorbing the forces generated by the rolling process with ease.

Still another object of this invention is to provide a rolling mill which eliminates the drawbacks of earlier systems.

SUMMARY OF THE INVENTION

The invention is primarily applicable to rolling mills of the inclined roll or Diescher roll (piercing mill) type wherein the mill stand is composed of cast elements, welded plate elements or forged elements which can be anchored to the foundation slab which is provided in a foundation for the mill.

In particular, the rolling mill can comprise:

a foundation provided with a cast base slab anchored in the foundation;

a pair of spaced apart portal frames affixed to the base slab and disposed opposite one another and forming a mill stand;

an upper roll cassette and a lower roll cassette receiving upper roll and lower roll units, respectively, received between the portal frames and spacing the portal frames apart, the upper and lower roll units being positioned to roll a workpiece between them; and a multiplicity of tension elements spanned between the portal frames and spaced apart from one another and bracing the portal frames against the cassettes and securing the frames and the cassettes together.

More particularly, the objects outlined above are attained, in accordance with the invention by providing the mill stand such that it is comprised of two portal frames which are affixed to the cast base slab and so tied together by tension elements that a spacing between them is defined by an upper cassette for an upper roll unit and a lower cassette for a lower roll unit.

The tension elements or tie bolts drawing the portal frames toward one another, and fixing the portal frames relative to one another may be spaced apart one above another and/or one alongside another.

This stand construction is greatly simplified by comparison with earlier roller stand constructions since it allows the use of lighter, more easily handled modular units which can be fabricated economically. The modular construction requires only four module group to be provided of which each two can be identical or at least relatively similar. The result is a more economical and more easily monitored construction, the rolling process forces being directed into the portal frames and absorbed thereby and by the foundation. The system of the invention also has the advantage that it provides an optimum load and mass distribution so that no overloaded stress state can exist anywhere in the system.

FEM exploration has shown that the stand has high stiffness to thereby ensure the product quality.

The modular construction enables optional selection of the sizes of the parts. Experience has shown that the roll mills of the invention can be made about 15% less expensively because the invention broadens the circle of material suppliers even for the cast and forged parts. The flexibility in producing the rolling mill and in obtaining the parts thereof can so simplify fabrication that the time between purchase of the parts and initial operation can be reduced significantly, problems hitherto encountered with selection of materials can be eliminated and other difficulties encountered in bringing a mill into operation can be eliminated whether the starting structures are forged parts or are parts fabricated from high quality plate.

The forces which are applied to the stand are easily taken up by the two portal frames and transmitted directly into the sole plate and by the sole plate into the foundation or are taken up by the cassettes and short circuited by them.

It has been found to be advantageous to provide upper and lower transverse frames connecting the portal frames together. A transverse head can be provided and can be equipped with a roll structure in the form of a superstructure or an internal structure guiding the roll assembly between the portal frames, preferably in upper guides which are provided parallel to one another. The lower transverse frame and the transverse head apply the roll forces which arise vertically to the portal frames.

In one type of inclined roll stand, the rolls are advantageously formed as lower and upper driven units with conical rolls.

In addition, at least the devices for feed angle adjustment and roll-drum counterweight or balancing can be mounted on the cassette.

When the mill is a Diescher roll mill, the conical rolls can have a Diescher disk on a Diescher disk slide which can be displaceable to the roll direction along tracks from the operating or working position into a replacement condition and back again. With conventional barrel-shaped or conical inclined roll units, the Diescher disks are mounted in rockers on the longitudinal sides of the mill stand. The pivotable arrangement and the hydraulic lock on the roll mill frame result during the rolling process in a "vent" process of the vibrations which has a negative effect on the rolling quality. During the vibrations free spaces on both sides of the mill frame are lost by the swinging action of the rocker and could be used better otherwise. The roll forces which are effective on the Diescher disks are taken by hydraulically actuated locks by the roll stand and contributed to additional loading thereon. A further factor is that the Diescher disk slide can be held, in accordance with the invention, by a toggle locking linkage. The positions of the Diescher disks in operation and during replacement of the Diescher disks can thus be exactly and securely held. According to a feature of the invention the Diescher disk slide is centered on a formation or mounting fastened on the lower cassette.

The rolls may be driven by universal joint shafts as described in German Patent DE 43 32 893 C1. To further save space, the system of the invention has a universal joint shaft which can be moved away from the driven roll shaft and can have, in the member which melts and engages the roll shaft a hydraulically actuatable clamp, The construction and fabrication of the mill frame is also influenced by other functions and devices. For example, the requisite space and weight of the frame can be matched to a minimum length of the roll axes. Furthermore by suitable choice of the drive, the overall volume of the mill frame can be limited.

BRIEF DESCRIPTION OF THE DRAWING

The above and other objects, features, and advantages will become more readily apparent from the following description, reference being made to the accompanying drawing in which:

FIG. 3 is a vertical section through the mill pivotal to the rolling direction;

FIG. 4 is a detail of the center device for the Diescher disk slide; and

SPECIFIC DESCRIPTION

Figure 1:
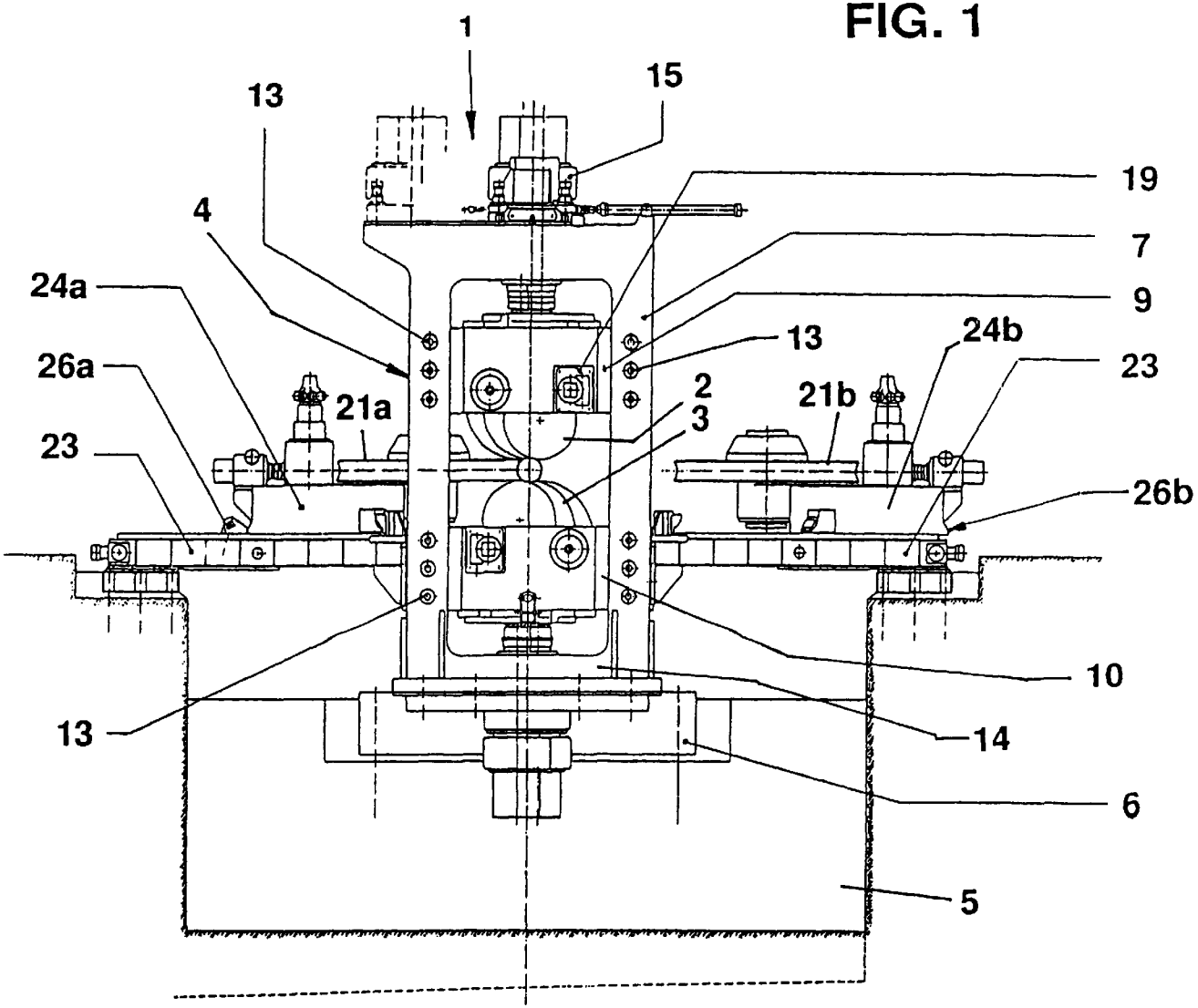
FIG. 1 is an end view of a rolling mill with conical inclined rollers formed with Diescher disks.

The rolling mill 1, which can be an inclined roll mill or a Diescher roll mill (piercing roll mill), is assembled in a modular manner from a number of part groups. The mill comprises an upper roll 2 and a lower roll 3 which are journaled in the stand 4 and the latter can be formed from parts which are cast and/or fabricated from welded steel plate and/or fabricated from forged parts. Basically the stand as a whole is anchored in a foundation 5 and, in particular, on a cast base plate 6 secured to the foundation.

According to the invention, the stand 4 is comprised of two spaced apart portal frames 7 and 8 which are separated by spacers formed by an upper cassette 9 and a lower cassette 10. The upper roll 2 and the upper cassette 9 form an upper roll unit 11 while the lower roll 3 and the lower cassette 10 form a lower roll unit.

The portal frames 7 and 8 are tied together by tension elements 13 such as tie rods, which are under a pretension as they span between the frames, e.g. while passing through the cassettes as shown in FIG. 3 to render the stand formed by the cassettes, the portal frames and the tie rods 13 substantially rigid.

The portal frames 7 and 8 can also be connected by a lower transverse frame 14 and a transverse head 15 at the top of the frames. The head 15 can be shiftable between the portal frames 7 and 8 in respective guide tracks 16*a* and 16*b* to facilitate insertion and removal of the roll units.

The rolls 2 and 3 are part of an upper drum unit 17*a* and a lower drum unit 17*b* and each of the rolls 2, 3 can be configured as a conical roll by 3 they may be with Diescher disks if desired. If the device 19 for adjusting the feet angle and the roll-drum balancing device 20 are connected to the cassettes 9 and 10.

Figure 2:
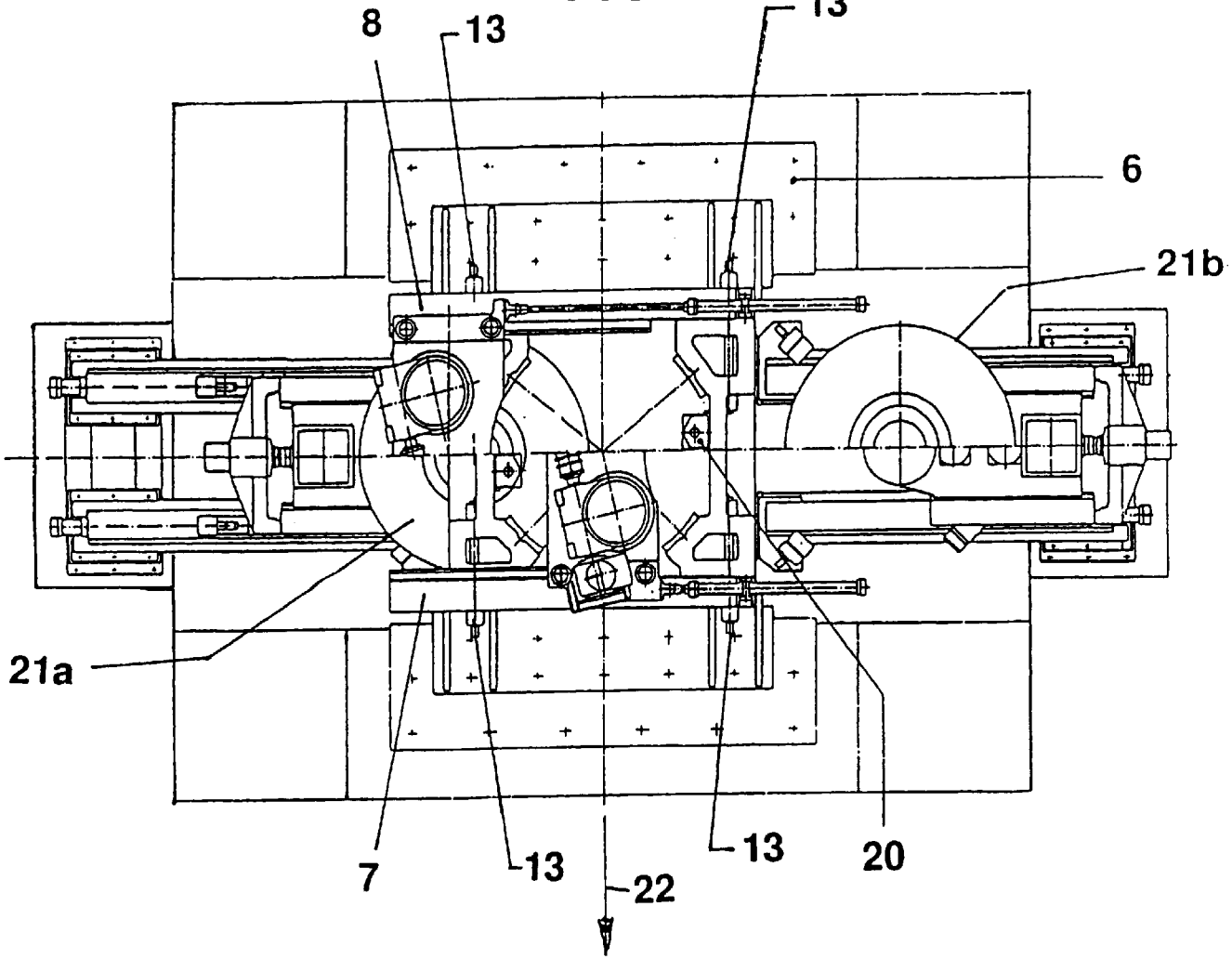
FIG. 2 is a plan view of the mill of FIG. 1.
Figure 5:
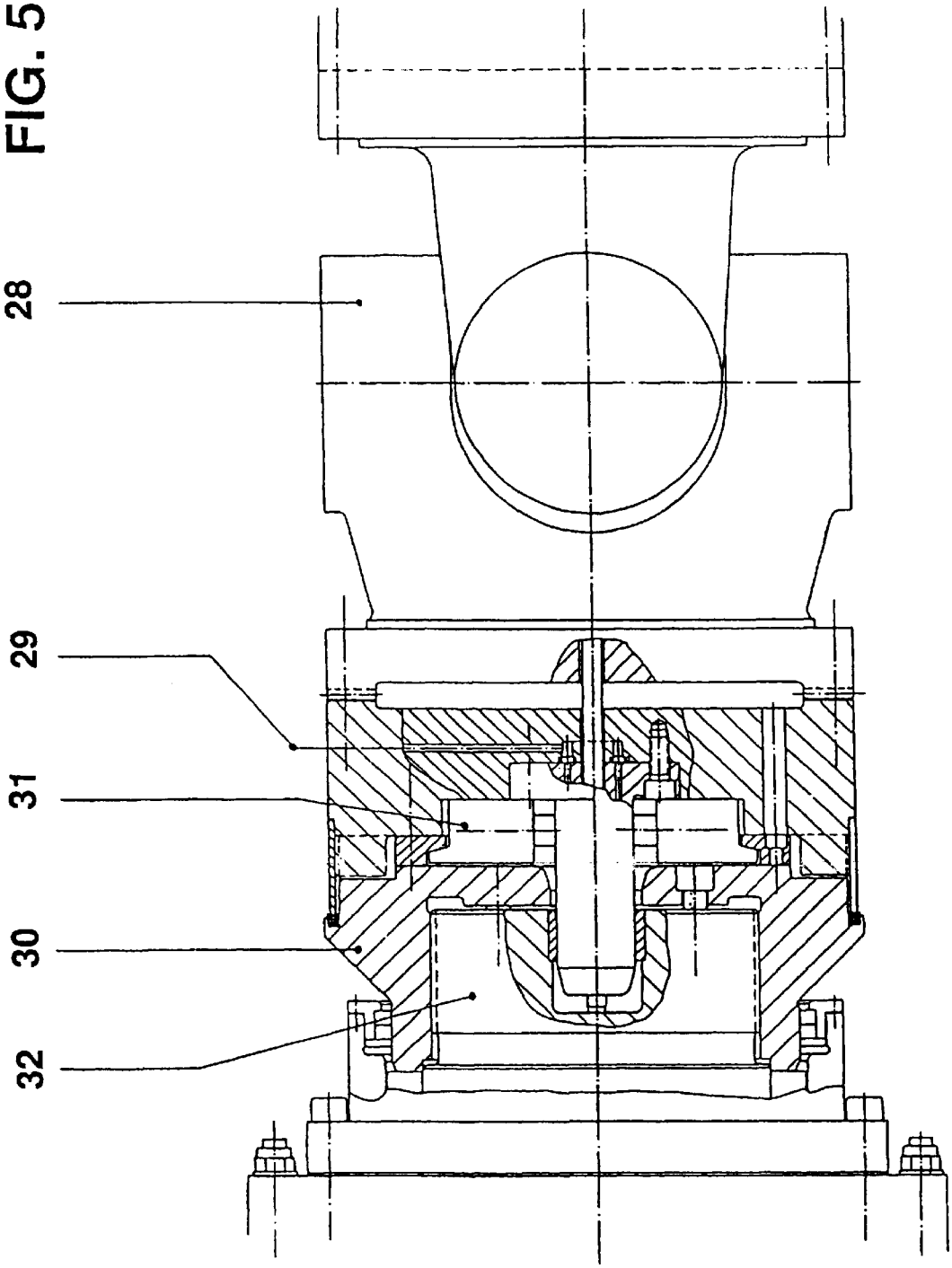
FIG. 5 is a partial longitudinal section through the retracted universal joint shaft of the mill drive.

The conical rolls 18 are associated with the Diescher disks 21*a* and 21*b* which are displaceable on Diescher disk slides 24*a* and 24*b* back and forth on tracks 23 transversely to the roll direction represented by the arrow 22 (FIG. 2). In FIGS. 1 and 2, the left Diescher disk 21*a* is in its operating position while the right hand Diescher disk 21*b* is in a maintenance or ready position outside the operating position and in a waiting or maintenance position in which a Diescher disk can be replaced, for example, in case of a dimension change in the rolled product 25. The Diescher disk slides 24*a* and 24*b* can be locked to the rails 23 by a toggle lock 26*a*, 26*b*. The respective Diescher disk slides 24*a* and 24*b* can be centered via a mounting 27 on a lower cassette 10 of the apparatus. As can be seen from FIG. 5, the drive force is transmitted to the rolls 2, 3 of the roll stand 4 by means of a retracted universal shank 28. The universal joint shank 28 has a quick connect coupling 29 which has a receiver 30 on the roll side with hydraulically actuated clamping of the roll shaft 32. The size and weight of the roll frame 4 is matched to a minimal length of the roll shaft 32 and the entire structure is highly compact as a result.

We claim:

1. A rolling mill comprising:

a foundation provided with a cast base plate anchored in said foundation;

a pair of spaced apart portal frames affixed to said base plate and disposed opposite one another and forming a mill stand;

an upper roll cassette and a lower roll cassette receiving upper roll and lower roll units, respectively, received between said portal frames and spacing said portal frames apart, said upper and lower roll units being positioned to roll a workpiece between them; and a multiplicity of tension elements spanned between said portal frames and spaced apart from one another and bracing said portal frames against said cassettes and securing said frames and said cassettes together.

2. The rolling mill defined in claim 1 wherein said roll units are inclined roll units.

3. The rolling mill defined in claim 1 wherein said roll units are Diescher roll units.

4. The rolling mill defined in claim 1, further comprising a transverse frame interconnecting said portal frames at bottoms of said portal frames.

5. The rolling mill defined in claim 1, further comprising a transverse head displaceable between said portal frames at tops thereof along guides formed on said portal frames.

6. The rolling mill defined in claim 1 wherein the roll units include an under drum unit and an over drum unit with respective conical rolls.

7. The rolling mill defined in claim 1 wherein each cassette is provided with a device for feed-angle adjustment and counterbalancing respective rolls.

8. The rolling mill defined in claim 1 wherein said roll units include conical rolls with at least one Diescher disk on a respective Diescher disk slide shiftable transversely to a rolling direction between an operating position into a roll change position and back along a track.

9. The rolling mill defined in claim 8, further comprising a toggle lever lock for securing said slide along said track.

10. The rolling mill defined in claim 8, further comprising an adjustable mounting on said lower cassette and on which said Diescher disk slide is centered.

11. The rolling mill defined in claim 1, further comprising a retractable articulated shaft connectable to one of said rolls for driving said one of said rolls, said articulated shaft having a quick-connect coupling formed with a receiver engaging the respective roll and provided with a hydraulically actuatable clamp for securing said receiver to said respective roll.

12. The rolling mill defined in claim 1 wherein said stand is dimensioned or has a weight matched to a minimum length of a roll axis.

* * * * *